US009359105B2

(12) United States Patent
Maddox, Jr.

(10) Patent No.: US 9,359,105 B2
(45) Date of Patent: Jun. 7, 2016

(54) ROLLED TISSUE DISPENSER

(71) Applicant: Rowland A. Maddox, Jr., Upland, CA (US)

(72) Inventor: Rowland A. Maddox, Jr., Upland, CA (US)

( * ) Notice: Subject to any disclaimer, the term of this patent is extended or adjusted under 35 U.S.C. 154(b) by 0 days.

(21) Appl. No.: 14/861,659

(22) Filed: Sep. 22, 2015

(65) Prior Publication Data

US 2016/0107790 A1 Apr. 21, 2016

Related U.S. Application Data

(60) Provisional application No. 62/066,526, filed on Oct. 21, 2014.

(51) Int. Cl.

| | |
|---|---|
| ***B65D 5/72*** | (2006.01) |
| ***B65D 5/42*** | (2006.01) |
| ***B65D 5/30*** | (2006.01) |
| ***B65D 5/02*** | (2006.01) |
| ***B65D 5/20*** | (2006.01) |

(52) U.S. Cl.

CPC ..... *B65D 5/72* (2013.01); *B65D 5/0227* (2013.01); *B65D 5/0254* (2013.01); *B65D 5/2052* (2013.01); *B65D 5/30* (2013.01); *B65D 5/4266* (2013.01)

(58) Field of Classification Search

CPC ..... B65D 5/72; B65D 5/0254; B65D 5/2052; B65D 5/30; B65D 5/4266; A47G 21/184; A47G 10/424

USPC ..... 229/103.2, 87.01, 122.1; 220/23.91, 220/592.24; 206/155; 221/305

See application file for complete search history.

(56) References Cited

U.S. PATENT DOCUMENTS

| | | | | | |
|---|---|---|---|---|---|
| 3,706,397 | A * | 12/1972 | Zeilinger | A47F 1/10 | 221/311 |
| 4,658,984 | A * | 4/1987 | Brunner | B65D 5/721 | 206/443 |
| 4,805,765 | A * | 2/1989 | Barrett | B65D 5/724 | 206/738 |
| 4,830,270 | A * | 5/1989 | Holmes | B65D 5/0254 | 206/807 |
| 2012/0074211 | A1 * | 3/2012 | Gelardi | B65D 5/16 | 229/5.81 |

* cited by examiner

*Primary Examiner* — Christopher Demeree
(74) *Attorney, Agent, or Firm* — Maschoff Brennan

(57) ABSTRACT

An apparatus for forming a container is provided. The apparatus may include a blank that includes: a first support panel defining a first height; a second support panel; a first bridge panel connected between the first support panel and the second support panel, the first bridge panel defining a second height; and a second bridge panel connected between the first support panel and the second support panel. The apparatus may further include a flexible sheet extending from a first end to a second end, defining a sheet length, and configured to form a first concavity. In some embodiments, the sheet length may exceed lengths defined by the first and second bridge panels. Alternately or additionally, the first height of the first support panel may be less than the second height of the first bridge panel.

20 Claims, 7 Drawing Sheets

ROLLED TISSUE DISPENSER

CROSS-REFERENCE TO RELATED APPLICATION

This application claims the benefit of U.S. Provisional Application No. 62/066,526, filed Oct. 21, 2014.

BACKGROUND

1. Field

Embodiments disclosed herein relate to a container. In particular, some embodiments described herein relate to containers suitable for storage and dispensing rolled sheeting materials.

2. Background

In a multitude of industries, materials are typically provided in the form of sheeting, such as paper products (e.g., bath tissue, paper towels, wrapping paper), plastic films (e.g., plastic wrap, film stock, adhesive tape), and vinyl films (e.g., vinyl wrap, covers, upholstery). Oftentimes, the sheeting is packaged as individual rolls.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

An example embodiment may include an apparatus for forming a container, including a blank and a flexible sheet. The blank may include: a first support panel having a first side edge, a second side edge, a top edge, and a bottom edge, and defining a first height between the top and bottom edge of the first support panel; a second support panel having a first side edge, a second side edge, a top edge, and a bottom edge; a first bridge panel connected between the second side edge of the first support panel and the first side edge of the second support panel, the first bridge panel having a first side edge, a second side edge, a top edge, and a bottom edge, and defining a second height between the top and bottom edge of the first bridge panel; and a second bridge panel connected to the second side edge of the second support panel, the second bridge panel having a first side edge, a second side edge, a top edge, and a bottom edge. The flexible sheet may extend from a first end to a second end, may define a sheet length, and may be configured to form a first concavity along a first contact surface. The sheet length may exceed lengths defined by the top edges of the first and second bridge panels. The first height of the first support panel may be less than the second height of the first bridge panel.

Another example embodiment may include a container including: a first support panel having a first side edge, a second side edge, a top edge, and a bottom edge, and defining a first height between the top and bottom edge of the first support panel; a second support panel having a first side edge, a second side edge, a top edge, and a bottom edge; a first bridge panel connected between the second side edge of the first support panel and the first side edge of the second support panel, the first bridge panel having a first side edge, a second side edge, a top edge, and a bottom edge, and defining a second height between the top and bottom edge of the first bridge panel; a second bridge panel connected between the second side edge of the second support panel and the first side edge of the first support panel, the second bridge panel having a first side edge, a second side edge, a top edge, and a bottom edge; and a flexible sheet extending from the first support panel to the second support panel and defining a first concavity. The first height of the first support panel may be less than the second height of the first bridge panel.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages of the claimed subject matter will be set forth in the description which follows, and in part will be obvious from the description, or may be learned by the practice of the claimed subject matter.

BRIEF DESCRIPTION OF THE DRAWINGS

To further clarify the above and other features of the claimed subject matter, a more particular description of the claimed subject matter will be rendered by reference to specific embodiments thereof which are illustrated in the appended drawings. It is appreciated that these drawings depict only some typical embodiments and are therefore not to be considered limiting. The claimed subject matter will be described and explained with additional specificity and detail through the use of the accompanying drawings in which:

DETAILED DESCRIPTION OF SOME EXAMPLE EMBODIMENTS

Particular embodiments of the present disclosure will be described with reference to the accompanying drawings. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of configurations, all of which are explicitly contemplated herein.

Generally speaking, some embodiments herein may relate to a container configured to store and dispense sheeting material. In some instances, sheeting material may be sold or provided without a convenient system to store or dispense the sheeting, because the end user is expected to already own a system to store or dispense the sheeting. For example, restrooms are commonly equipped with a bath tissue holder, and manufacturers of bath tissue accordingly do not package their products with a system to store or dispense the tissue. However, in many situations, it may be convenient for an end user to have a system to store or dispense rolled sheeting in order to prevent the rolled sheeting material from rolling away and/or unraveling. For instance, bath tissue may be used for unconventional (e.g., as a substitute for facial tissue) or away from an ordinary restroom (e.g., on camping trips). Some embodiments herein may relate to a container configured to store and dispense sheeting material that may address the needs and problems discussed above.

Embodiments of the present disclosure will now be explained with reference to the accompanying figures.

Figure 1A:
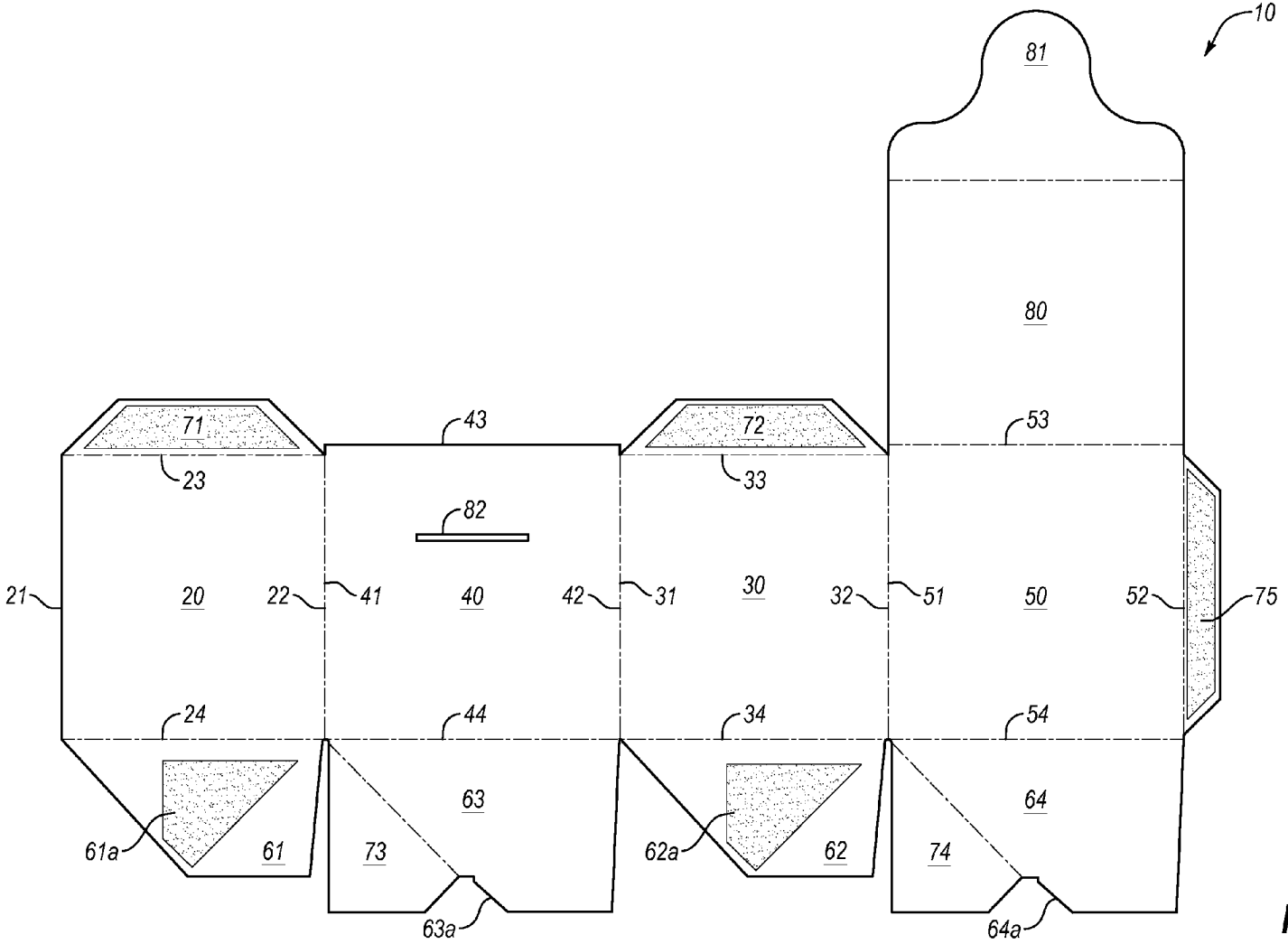
FIG. 1A illustrates a plan view of one embodiment of an example blank in an unassembled state.
Figure 1B:
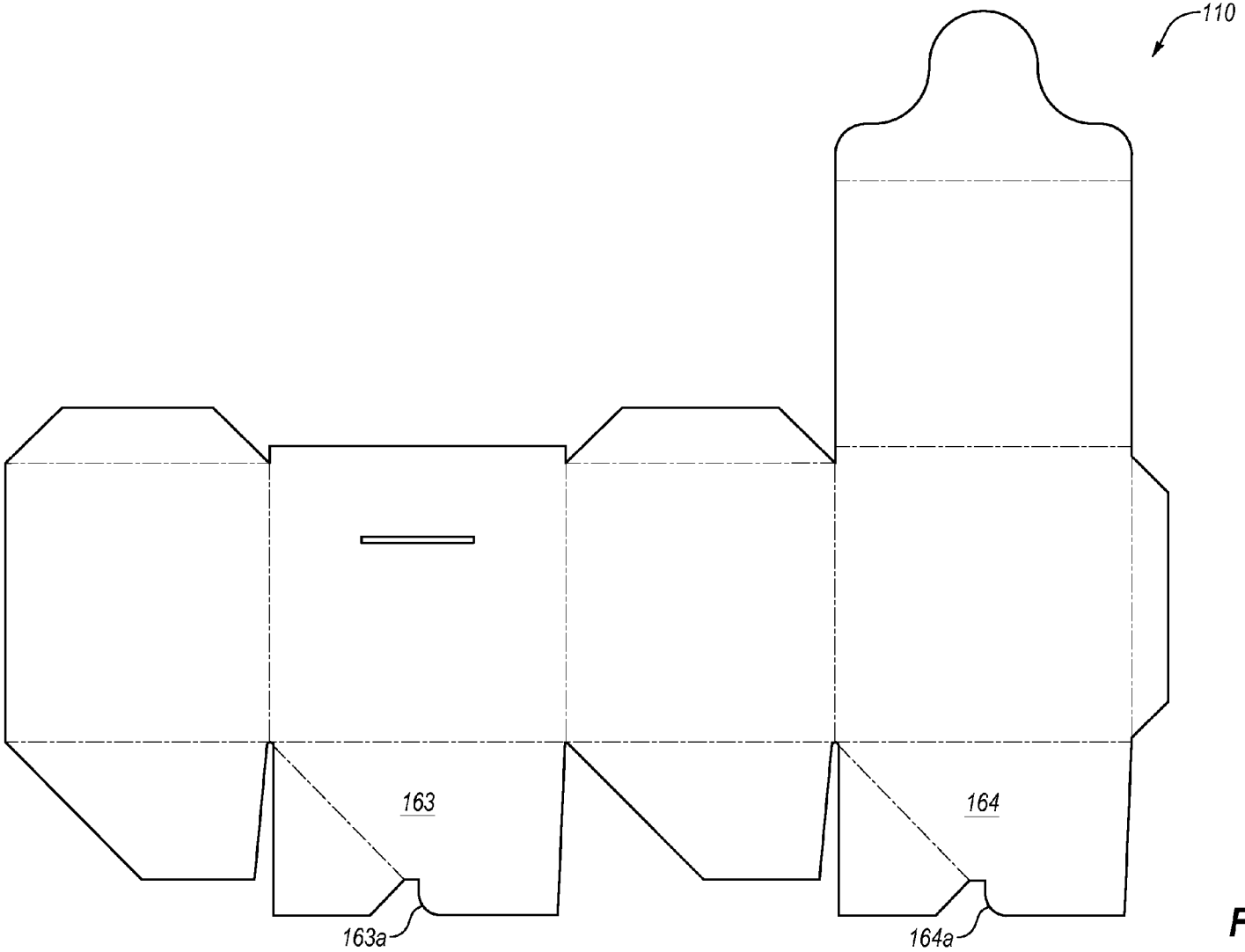
FIG. 1B illustrates a plan view of another embodiment of an example blank in an unassembled state.
Figure 1C:
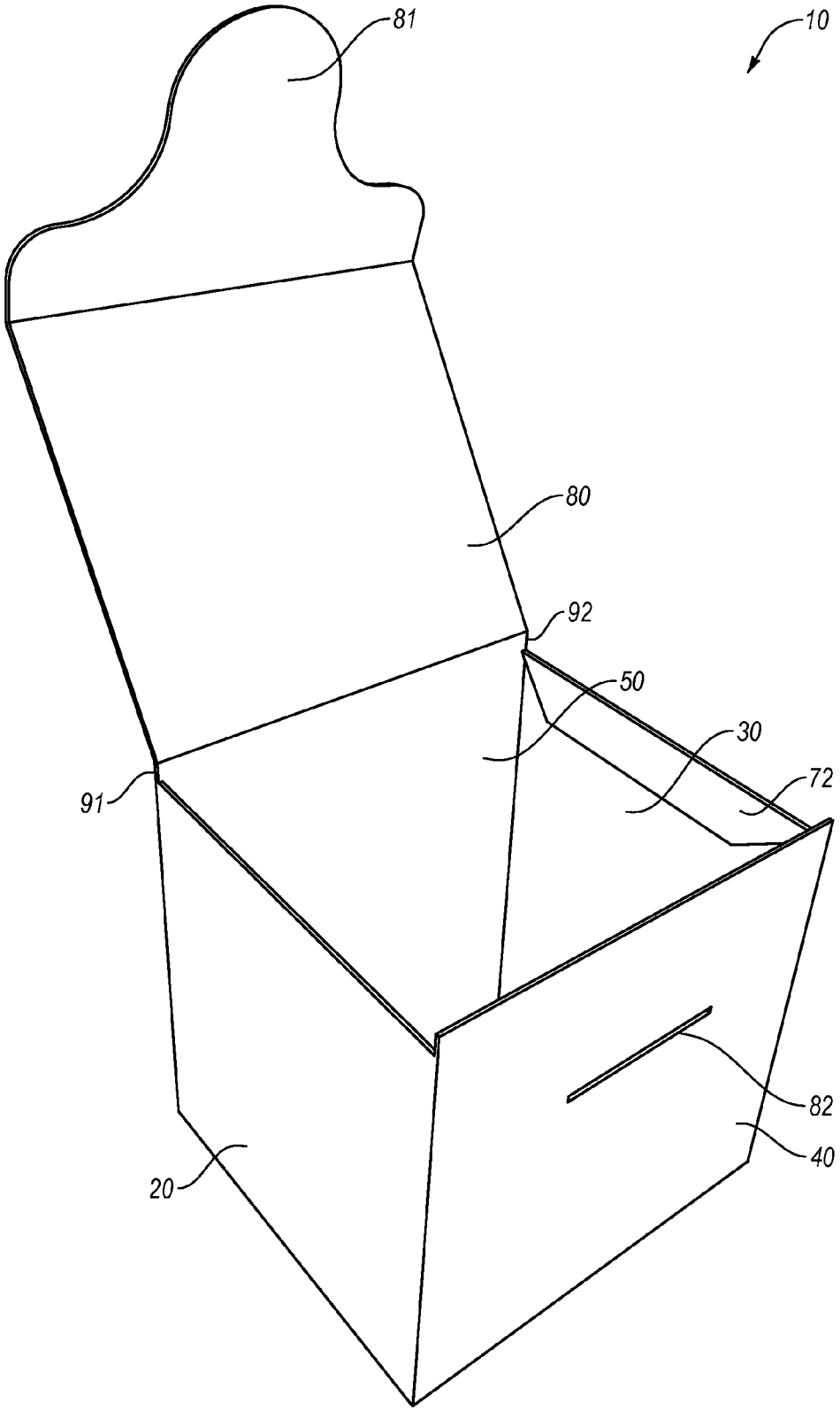
FIG. 1C illustrates a perspective view of the blank of FIG. 1A in an assembled state.

FIG. 1A illustrates an example blank 10 in an unassembled state. The blank 10 may include a first support panel 20, a second support panel 30, a first bridge panel 40, and a second bridge panel 50. The first and second support panels 20, 30 and first and second bridge panels 40, 50 may each include respective first side edges 21, 31, 41, 51; second side edges 22, 32, 42, 52; top edges 23, 33, 43, 53; and bottom edges 24, 34, 44, 54. The first side edge 41 of the first bridge panel 40 may be connected to the second side edge 22 of the first support panel 20. The first side edge 31 of the second support panel 30 may be connected to the second side edge 42 of the first bridge panel 40. The first side edge 51 of the second bridge panel 50 may be connected to the second side edge 32 of the second support panel 30. The first and second side edges 21, 31, 22, 32 of the first and second support panels 20, 30 may be shorter in length than the first and second side edges 41, 51, 42, 52 of the first and second bridge panels 40, 50, such that first and second access slots 91, 92 may be formed when the blank 10 is transitioned into an assembled state as illustrated in FIG. 1C.

Blank 10 may further include a first base panel 61, a second base panel 62, a third base panel 63, and a fourth base panel 64. The first and second base panels 61, 62 may be connected, respectively, to the bottom edges 24, 34 of the first and second support panels 20, 30 and may include first and second securement areas 61*a*, 62*a*. The third and fourth base panels 63, 64 may be connected, respectively, to the bottom edges 44, 54 of the first and second bridge panels 40, 50 and may extend, respectively, to engagement edges 63*a*, 64*a*.

Blank 10 may further include a first fastening panel 71, a second fastening panel 72, a third fastening panel 73, a fourth fastening panel 74, and a fifth fastening panel 75. The first fastening panel 71 may be connected to the top edge 23 of the first support panel 20. The second fastening panel 72 may be connected to the top edge 33 of the second support panel 30. The third fastening panel 73 may be connected to the third base panel 63. The fourth fastening panel 74 may be connected to the fourth base panel 64. The fifth fastening panel 75 may be connected to the second side edge 52 of the second bridge panel 50.

Blank 10 may further include a latch panel 80. The latch panel 80 may be connected to the top edge 53 of the second bridge panel 50 and may include a latch edge 81 opposite its connection to the second bridge panel 50. The latch edge 81 may be configured to removably engage with a latch slot 82 provided along the first bridge panel 40.

The connections among the various panels 20, 30, 40, 50, 61, 62, 63, 64, 71, 72, 75, 80 may be implemented by a hinged relationship to facilitate assembly of the blank 10 into an assembled state as illustrated in FIG. 1C, as well as disassembly back into the unassembled state of FIG. 1A. The hinged relationship, indicated by dotted lines in FIGS. 1A and 1B, may promote precise folding of the blank 10 at select positions to help to ensure proper assembly and disassembly.

In the assembled state as illustrated in FIG. 1C, the first and second support panels 20, 30 may be folded toward one another relative to the first bridge panel 40, such that the support panels 20, 30 may extend perpendicularly from the first bridge panel 40. The second bridge panel 50 may be folded toward the first bridge panel 40 and the fifth fastening panel 75 may be secured to an area of the first support panel 20 proximate its first side edge 21, such that first side edge 21 and second side edge 52 are proximate one another.

Furthermore, the first and second fastening panels 71, 72 may be folded inward and secured to, respectively, an area of the first and second support panels 20, 30 proximate their top edges 23, 33. The first and second base panels 61, 62 may be folded inward such that they each extend perpendicularly from, respectively, the first and second support panels 20, 30. The third and fourth base panels 63, 64 may be folded inward such that they extend perpendicularly from, respectively, the first and second bridge panels 40, 50, and such that engagement edges 63*a*, 64*a* interlock with one another to secure the assembled state of the blank 10. The third and fourth fastening panels 73, 74 may be secured to, respectively, the first and second securement areas 61*a*, 62*a* of the first and second base panels 61, 62. The securement of the first, second, third, fourth, and fifth fastening panels 71, 72, 73, 74, 75 may be achieved by applying an adhesive on the shaded areas shown on the first, second and fifth fastening panels 71, 72, 75 and the first and second securement areas 61*a*, 62*a* of the first and second base panels 61, 62.

Lastly, the latch panel 80 may be folded toward the base panels 61, 62, 63, 64 such that the latch edge 81 may be folded toward and removably inserted into the latch slot 82. With the latch panel 80 folded down, first and second access slots 91, 92, as illustrated in FIG. 1C, may be formed adjacent the first and second support panels 20, 30.

Figure 1D:
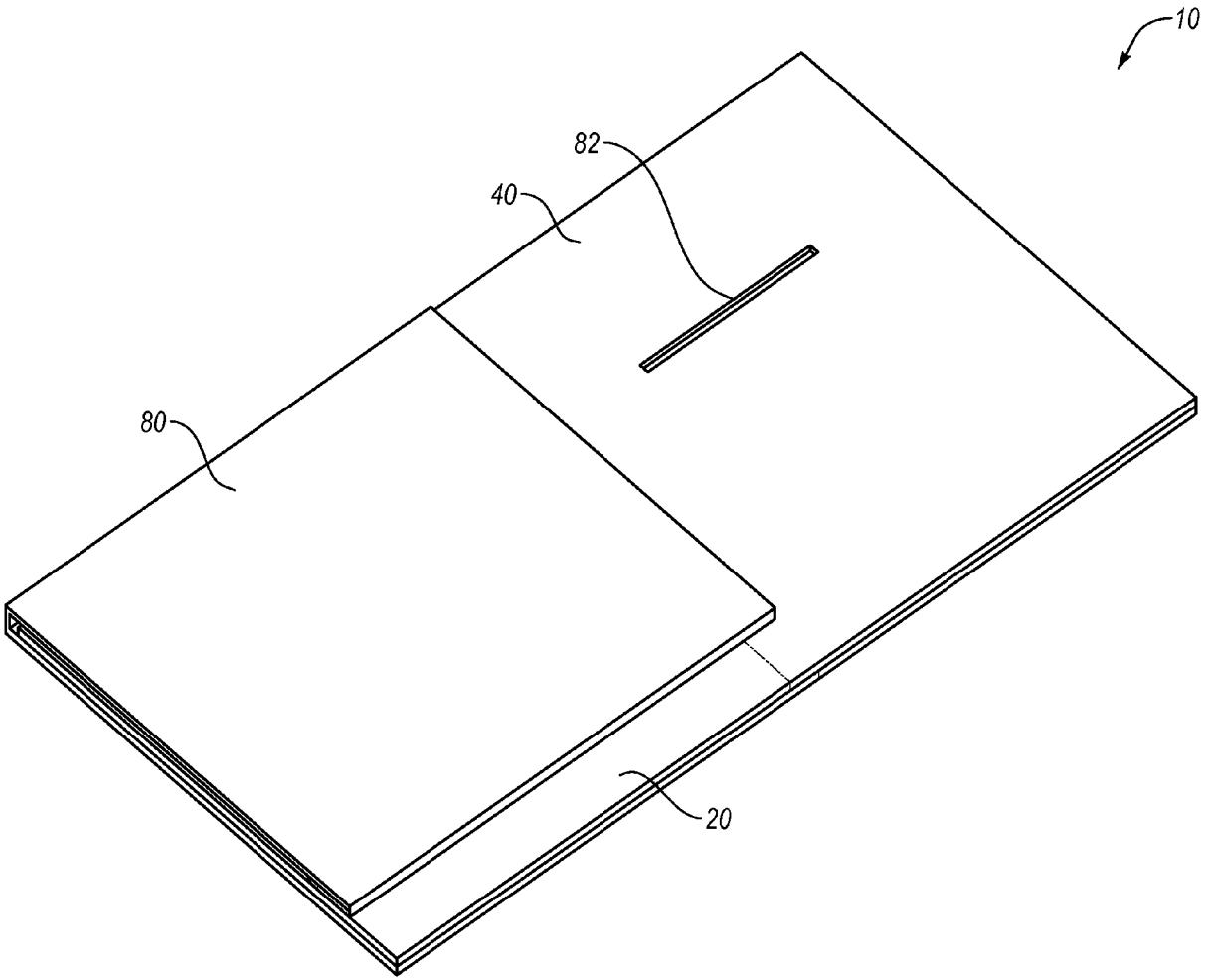
FIG. 1D illustrates a perspective view of the blank of FIG. 1A in a collapsed-assembled state.

For portability, the blank 10 may be provided to consumers in a collapsed-assembled state as illustrated in FIG. 1D. In the collapsed-assembled state, the first and second base panels 61, 62 may collapse inward toward, respectively, the first and second support panels 20, 30. By virtue of their connections to the first and second base panels 61, 62 via the third and fourth fastening panels 73, 74, the third and fourth base panels 63, 64 may correspondingly collapse inward toward, respectively, the first and second bridge panels 40, 50. Simultaneously, the blank 10 may collapse inward such that the first support panel 20 and the second bridge panel 50 converge toward one another while the second support panel 30 and the first bridge panel 40 converge toward one another. Accordingly, in the collapsed-assembled state, the blank 10 may be substantially flattened and therefore easier to pack, store, or ship.

Alternatively, in another embodiment (FIG. 1B), the blank 110 may include third and fourth base panels 163, 164, defined by engagement edges 163*a*, 164*a*, respectively. The relatively curved profile of engagement edges 163*a*, 164*a* may further facilitate the securement of the blank 110 in its assembled state by providing a sturdier interlock between the third and fourth base panels 163, 164.

Modifications, additions, or omissions may be made to the blanks 10, 110 without departing from the scope of the present disclosure. In the example embodiments, the blanks 10, 110 may be formed from paperboard or cardboard. However, it is envisioned that the blanks 10, 110 may be derived from other materials, including but not limited to plastics, metals, and wood. For example, specific applications may require sturdier embodiments, thereby necessitating the use of stronger or more rigid materials such as metals. In these and other embodiments, the blanks 10, 110 may be preformed in their assembled states. Furthermore, a cutting device (e.g., serrated teeth) may be disposed adjacent to one or both of the access slots 91, 92 along the top edges 23, 33 of the support panels 20, 30. The proportions and dimensions of the blanks 10, 110 may also vary, for example, dependent upon the sheeting material to be stored therein. For example, the first and second support panels 20, 30 and first and second bridge panels 40, 50 of blank 10 define, respectively a To first, second, third, and fourth width between their respective first and second side edges 21 and 22, 31 and 32, 41 and 42, 51 and 52. Each of the widths are approximately equal such that blank 10 substantially forms a cube in its assembled state, illustrated in FIG. 1C. However, it is envisioned that these widths may differ such that an alternate embodiment may form, for example, a rectangle in its assembled state.

Figure 2:
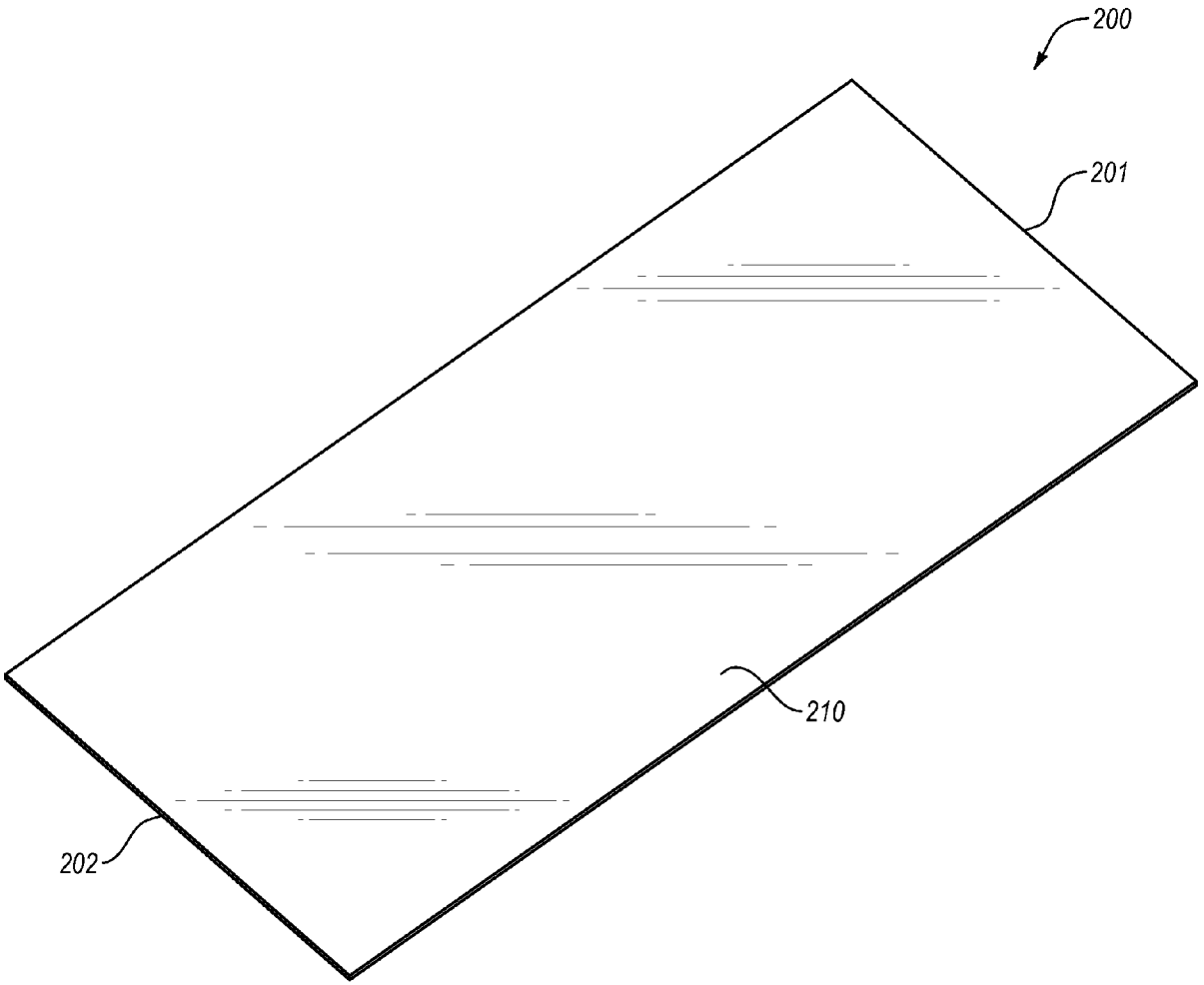
FIG. 2 illustrates a perspective view of one embodiment of an example flexible sheet.

FIG. 2 illustrates an example flexible sheet 200. The flexible sheet 200 may extend from a first end 201 to a second end 202, defining a contact surface 210 and spanning a length greater than the lengths of the top and bottom edges 43, 53, 44, 54 of the first and second bridge panels 40, 50. Accordingly, when disposed within the blank 10 in its assembled state to form a container 300 (FIG. 3A), the flexible sheet 200 may deflect such that a first concavity is formed along the contact surface 210.

Modifications, additions, or omissions may be made to the flexible sheet 200 without departing from the scope of the present disclosure. For example, contact surface 210 may include a low-friction surface or coating, such as a laminate coating. Alternatively, flexible sheet 200 may be derived from a flexible, low-friction surface suitable for its specific application. In other embodiments, a supporting surface may be provided in lieu of the flexible sheet 200, for example, where specific applications may require sturdier embodiments. The supporting surface may be a rigid, pre-formed component and, in some embodiments, may even be pre-formed with a blank to form a container. Furthermore, the proportions, dimensions, and flexibility of the flexible sheet 200 or supporting surface may vary, for example, dependent upon the sheeting material to be stored thereon.

Figure 3A:
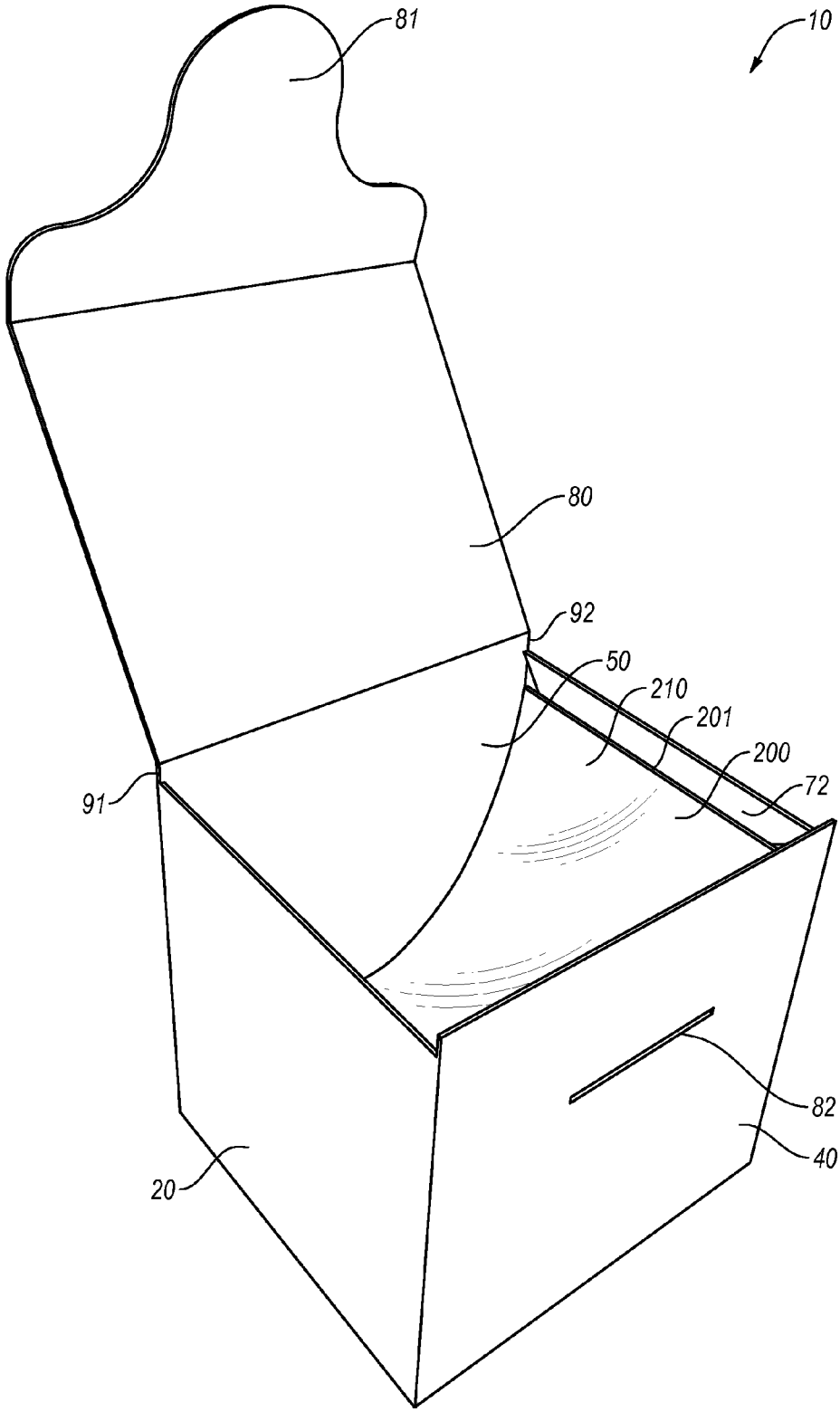
FIG. 3A illustrates a perspective view of the flexible sheet of FIG. 2 engaged within the blank of FIG. 1A to form an example container.
Figure 3B:
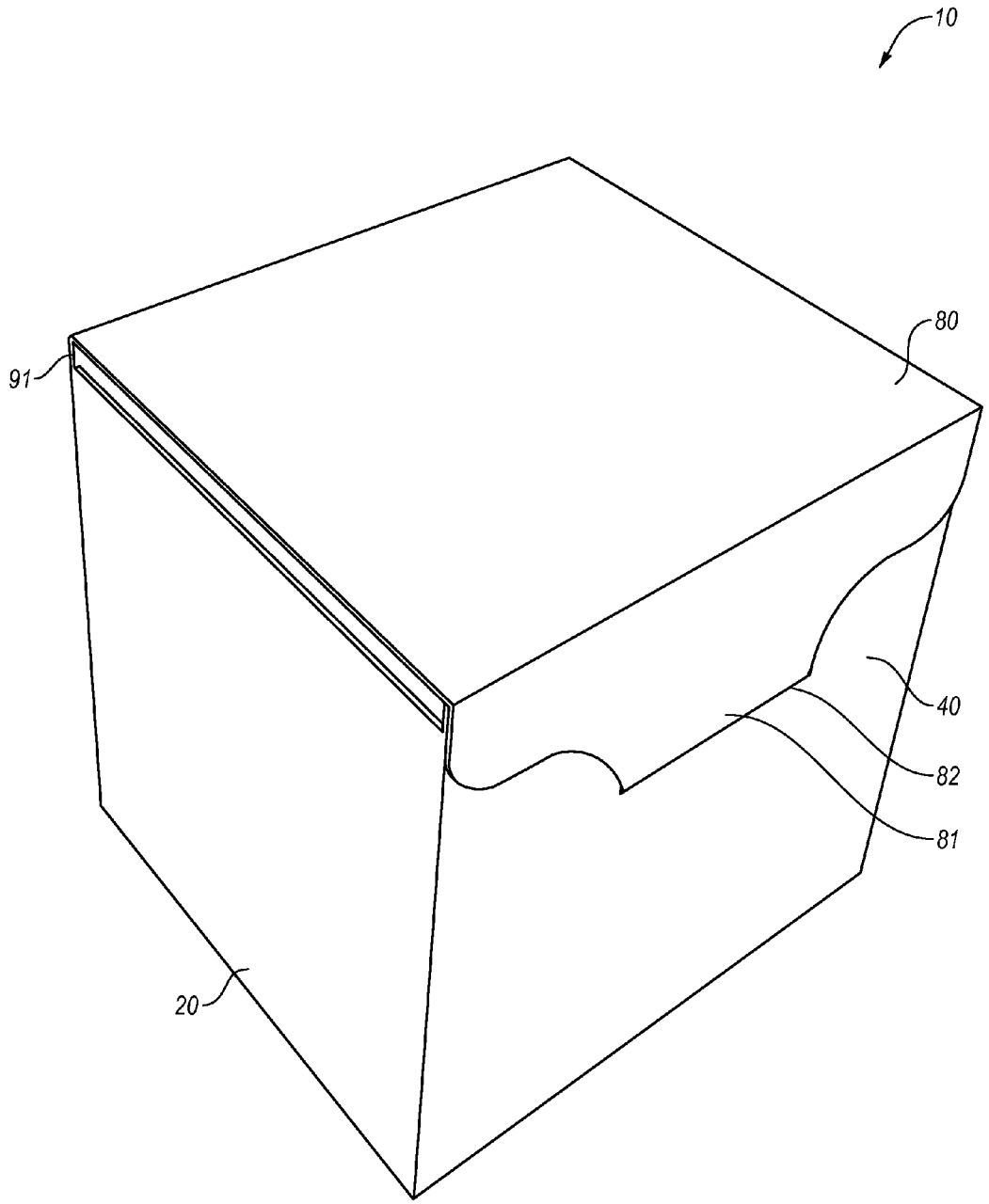
FIG. 3B illustrates a perspective view of the container of FIG. 3A in a closed configuration.

FIGS. 3A and 3B illustrate an example container 300. The container 300 may be constructed by transitioning the blank 10 into its assembled state and placing the flexible sheet 200 therein. By virtue of the relative difference in lengths between the flexible sheet 200 from its first to its second end 201, 202 and the blank 10 along its first and second bridge panels 40, 50, the flexible sheet 200 may be forced to deflect to form a first concavity along the contact surface 210. To secure the flexible sheet 200 within the blank 10, the first end 201 of the flexible sheet 200 may rest against the first fastening panel 71 and the second end 202 of the flexible sheet 200 may rest against the second fastening panel 72.

Modifications, additions, or omissions may be made to the container 300 without departing from the scope of the present disclosure. The relative proportions of the blank with the flexible sheet or supporting surface may vary to accommodate particular applications. For example, the blank may be configured to store sheeting material of particular dimensions and the length of the provided flexible sheet may be adjusted accordingly to account for the weight of the particular material to be supported thereon. In other embodiments, multiple flexible sheets may be provided to support the sheeting material at specific points. Alternately or additionally, multiple flexible sheets may be provided to form multiple curvatures within a single container in order to support multiple rolls of sheeting material. In still other embodiments, both the blank and supporting surface may be pre-formed together, such that the resultant container is a single unitary component.

In a method of using container 300 (FIGS. 3A and 3B), a consumer may receive the blank 10 in its collapsed-assembled state (FIG. 1D) and a flexible sheet 200 (FIG. 2A). The container 300 may be formed by transitioning the blank 10 into its assembled state, whereupon the flexible sheet 200 may be placed therein, with its contact surface 210 facing the latch panel 80 and its first and second ends 201, 202 resting against, respectively, the first and second fastening panels 71, 72. A roll of sheeting material, such as a roll of bath tissue, may be placed inside of the container 300 coaxially with the concavity formed by the flexible sheet 200. The sheeting material may contact and roll along the contact surface 210 and may accordingly be dispensed through either the first or second access slots 91, 92.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for forming a container, the apparatus comprising:

a flexible sheet extending from a first end to a second end, defining a sheet length and configured to form a first concavity along a contact surface; and a blank including:

a first support panel having a first side edge, a second side edge, a top edge, and a bottom edge, and defining a first height between the top and bottom edges of the first support panel;

a second support panel having a first side edge, a second side edge, a top edge, and a bottom edge;

a first bridge panel connected between the second side edge of the first support panel and the first side edge of the second support panel, the first bridge panel having a first side edge, a second side edge, a top edge, and a bottom edge, and defining a second height between the top and bottom edges of the first bridge panel;

a second bridge panel connected to the second side edge of the second support panel, the second bridge panel having a first side edge, a second side edge, a top edge, and a bottom edge;

a first base panel extending from the bottom edge of the first support panel;

a second base panel extending from the bottom edge of the second support panel;

a third base panel extending from the bottom edge of the first bridge panel;

a fourth base panel extending from the bottom edge of the second bridge panel and configured to interconnect with the third base panel;

a third fastening panel extending from the third base panel and configured to be secured to the first base panel; and a fourth fastening panel extending from the fourth base panel and configured to be secured to the second base panel, wherein the sheet length exceeds lengths defined by the top edges of the first and second bridge panels and the first height of the first support panel is less than the second height of the first bridge panel.

2. The apparatus of claim 1, wherein, in an assembled state of the blank:

the second side edge of the second bridge panel is secured to the first side edge of the first support panel;

the first and second bridge panels extend perpendicularly from the first and second support panels; and the flexible sheet is configured to be disposed within the blank in its assembled state, such that:

the first end of the flexible sheet rests against the first support panel;

the second end of the flexible sheet rests against the second support panel; and the flexible sheet forms the first concavity along the contact surface.

3. The apparatus of claim 1, wherein:

the second support panel defines a third height between the top and bottom edges of the second support panel; and the third height of the second support panel is less than the second height of the first bridge panel.

4. The apparatus of claim 1, wherein:

the first support panel includes a first fastening panel configured to secure the first end of the flexible sheet; and the second support panel includes a second fastening panel configured to secure the second end of the flexible sheet.

5. The apparatus of claim 1, further comprising a latch panel connected to the top edge of the second bridge panel and extending therefrom to a latch edge, wherein the first bridge panel includes a latch slot configured to removably engage with the latch edge.

6. The apparatus of claim 1, wherein the first and second support panels are connected to the first and second bridge panels through a hinged relationship.

7. The apparatus of claim 1, wherein the contact surface includes a low-friction coating.

8. The apparatus of claim 1, wherein:

the first support panel defines a first width between its first and second side edges;

the second support panel defines a second width between its first and second side edges;

the first bridge panel defines a third width between its first and second side edges; and the second bridge panel defines a fourth width between its first and second side edges.

9. The apparatus of claim 8, wherein the first, second, third, and fourth widths are equivalent.

10. The apparatus of claim 8, wherein:

the first and second widths are equivalent;

the third and fourth widths are equivalent; and the first and second widths are nonequivalent to the third and fourth widths.

11. The apparatus of claim 1, further comprising a fifth fastening panel extending from the second side edge of the second bridge panel, configured to be secured to the first side edge of the first support panel.

12. An apparatus for forming a container, the apparatus comprising:

a flexible sheet extending from a first end to a second end, defining a sheet length and configured to form a first concavity along a contact surface; and a blank including:

a first support panel having a first side edge, a second side edge, a top edge, and a bottom edge, and defining a first height between the top and bottom edges of the first support panel;

a second support panel having a first side edge, a second side edge, a top edge, and a bottom edge;

a first bridge panel connected between the second side edge of the first support panel and the first side edge of the second support panel, the first bridge panel having a first side edge, a second side edge, a top edge, and a bottom edge, and defining a second height between the top and bottom edges of the first bridge panel;

a second bridge panel connected to the second side edge of the second support panel, the second bridge panel having a first side edge, a second side edge, a top edge, and a bottom edge; and a latch panel connected to the top edge of the second bridge panel and extending therefrom to a latch edge, wherein the first bridge panel includes a latch slot configured to removably engage with the latch edge, wherein the sheet length exceeds lengths defined by the top edges of the first and second bridge panels and the first height of the first support panel is less than the second height of the first bridge panel.

13. The apparatus of claim 12, wherein, in an assembled state of the blank:

the second side edge of the second bridge panel is secured to the first side edge of the first support panel;

the first and second bridge panels extend perpendicularly from the first and second support panels; and the flexible sheet is configured to be disposed within the blank in its assembled state, such that:

the first end of the flexible sheet rests against the first support panel;

the second end of the flexible sheet rests against the second support panel; and the flexible sheet forms the first concavity along the contact surface.

14. The apparatus of claim 12, wherein:

the second support panel defines a third height between the top and bottom edges of the second support panel; and the third height of the second support panel is less than the second height of the first bridge panel.

15. The apparatus of claim 12, wherein:

the first support panel includes a first fastening panel configured to secure the first end of the flexible sheet; and the second support panel includes a second fastening panel configured to secure the second end of the flexible sheet.

16. The apparatus of claim 12, further comprising:

a first base panel extending from the bottom edge of the first support panel; and a second base panel extending from the bottom edge of the second support panel, wherein the first base panel is configured to interconnect with the second base panel.

17. The apparatus of claim 12, further comprising:

a first base panel extending from the bottom edge of the first support panel;

a second base panel extending from the bottom edge of the second support panel;

a third base panel extending from the bottom edge of the first bridge panel; and a fourth base panel extending from the bottom edge of the second bridge panel, wherein the first base panel is configured to interconnect with the second base panel; and the third base panel is configured to interconnect with the fourth base panel.

18. The apparatus of claim 12, further comprising:

a first base panel extending from the bottom edge of the first support panel;

a second base panel extending from the bottom edge of the second support panel;

a third base panel extending from the bottom edge of the first bridge panel;

a fourth base panel extending from the bottom edge of the second bridge panel;

a third fastening panel extending from the third base panel and configured to be secured to the first base panel; and a fourth fastening panel extending from the fourth base panel and configured to be secured to the second base panel, wherein the third base panel is configured to interconnect with the fourth base panel.

19. The apparatus of claim 12, wherein:

the first support panel defines a first width between its first and second side edges;

the second support panel defines a second width between its first and second side edges;

the first bridge panel defines a third width between its first and second side edges; and the second bridge panel defines a fourth width between its first and second side edges.

20. The apparatus of claim 19, wherein:

the first and second widths are equivalent;

the third and fourth widths are equivalent; and the first and second widths are nonequivalent to the third and fourth widths.

* * * * *